US009682570B2

(12) United States Patent
Okayama

(10) Patent No.: US 9,682,570 B2
(45) Date of Patent: Jun. 20, 2017

(54) LIQUID SUPPLY DEVICE AND IMAGE RECORDING APPARATUS

(71) Applicant: FUJIFILM Corporation, Tokyo (JP)

(72) Inventor: Yoshiyuki Okayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/233,407

(22) Filed: Aug. 10, 2016

(65) Prior Publication Data

US 2016/0347080 A1 Dec. 1, 2016

Related U.S. Application Data

(63) Continuation of application No. PCT/JP2014/081574, filed on Nov. 28, 2014.

(30) Foreign Application Priority Data

Mar. 31, 2014 (JP) ..... 2014-071315

(51) Int. Cl.
*B41J 2/18* (2006.01)
*B41J 2/175* (2006.01)
*B41J 2/14* (2006.01)

(52) U.S. Cl.
CPC ..... *B41J 2/18* (2013.01); *B41J 2/175* (2013.01); *B41J 2/17596* (2013.01); *B41J 2/14048* (2013.01); *B41J 2202/12* (2013.01)

(58) Field of Classification Search
CPC ..... B41J 2/18; B41J 2/17596; B41J 2/14048; B41J 2202/12; B41J 2/175
See application file for complete search history.

(56) References Cited

U.S. PATENT DOCUMENTS 4,505,461 A * 3/1985 Kakimoto ..... F16F 13/103 267/140.13
2004/0027427 A1 2/2004 Tominaga
(Continued)

FOREIGN PATENT DOCUMENTS

JP H05-64897 A 3/1993
JP 2004-074462 A 3/2004
(Continued)

OTHER PUBLICATIONS

International Search Report issued in PCT/JP2014/081574; mailed Jan. 13, 2015.
(Continued)

*Primary Examiner* — Manish S Shah
*Assistant Examiner* — Yaovi M Ameh
(74) *Attorney, Agent, or Firm* — Studebaker & Brackett PC

(57) ABSTRACT

A liquid supply device and an image recording apparatus that do not cause the tearing of a diaphragm even if abnormal pressure is generated. The objective is solved by a liquid supply device that includes a back-pressure tank and a restriction member. The back-pressure tank is provided between an ink jet head and a pump, and includes a liquid chamber that communicates with an ink passage through a flow port, a gas chamber in which gas is stored, and an elastic diaphragm that isolates the liquid chamber from the gas chamber. The restriction member is disposed on an extension surface of the flow port of an inner wall surface of the liquid chamber, and keeps the elastic diaphragm on the inside of the extension surface in a case in which the elastic diaphragm is sucked into the flow port by pressure that is applied to ink by the pump.

19 Claims, 11 Drawing Sheets

(56) References Cited

U.S. PATENT DOCUMENTS

| | | | | |
|---|---|---|---|---|
| 2008/0231650 | A1* | 9/2008 | Kojima | B41J 2/055<br>347/17 |
| 2012/0140006 | A1* | 6/2012 | Yunoki | B41J 2/175<br>347/94 |

FOREIGN PATENT DOCUMENTS

| | | | |
|---|---|---|---|
| JP | 2008-230137 | A | 10/2008 |
| JP | 2013-180411 | A | 9/2013 |

OTHER PUBLICATIONS

Written Opinion issued in PCT/JP2014/081574; mailed Jan. 13, 2015.

* cited by examiner

| TENSILE STRENGTH (MPa) \ DIAMETER (mm) | LARGE (ϕ12.0) | MEDIUM (ϕ9.0) | SMALL (ϕ3.5) |
|---|---|---|---|
| HIGH 15 | B | A | A |
| MEDIUM 7.6 | B | B | A |
| LOW 3 | B | B | B |

LIQUID SUPPLY DEVICE AND IMAGE RECORDING APPARATUS

CROSS-REFERENCE TO RELATED APPLICATIONS

This application is a Continuation of PCT International Application No. PCT/JP2014/081574 filed on Nov. 28, 2014, which claims priority under 35 U.S.C §119 (a) to Japanese Patent Application No. 2014-071315 filed on Mar. 31, 2014. Each of the above application(s) is hereby expressly incorporated by reference, in its entirety, into the present application.

BACKGROUND OF THE INVENTION

1. Field of the Invention

The present invention relates to a liquid supply device and an image recording apparatus, and more particularly, to a pressure control technique that supplies liquid to a liquid ejection head.

2. Description of the Related Art

To stably supply ink to an ink jet head and to stably operate the ink jet head in an ink jet recording apparatus, pressure of an ink passage and the internal pressure of the ink jet head need to be controlled to be constant.

For this control of pressure, the fluctuation of the pressure of the ink passage and the fluctuation of the internal pressure of the ink jet head are suppressed by a damper provided on the ink passage. The damper includes a liquid chamber that communicates with an ink passage and a gas chamber that is provided so as to face the liquid chamber with an elastic diaphragm interposed therebetween, and a technique for protecting the elastic diaphragm from excessive deformation or damage is known.

For example, JP2008-230137A discloses a technique in which a device for adjusting the back-pressure of a liquid ejection head partitioned into a liquid storage chamber and a gas storage chamber by a movable diaphragm, which can be deformed, is provided with a stopper member for limiting the movable range of the movable diaphragm.

Further, JP2004-74462A discloses an air damper employing a structure in which a reinforcing plate is fixed to the surface of a diaphragm of an ink storage portion to prevent the swelling of the diaphragm.

SUMMARY OF THE INVENTION

However, since the stopper member is separately provided in the liquid storage chamber in the techniques disclosed in JP2008-230137A and JP2004-74462A, the number of components is increased. For this reason, there is a problem in that cost is increased. Further, it is difficult to determine a position where the stopper member is provided. Furthermore, since it is necessary to increase a range in which the stopper member is positioned to increase the control range by increasing the stretchable range of the diaphragm, there is a problem in that the size of the device is increased.

The invention has been made in consideration of these circumstances, and an object of the invention is to provide a liquid supply device and an image recording apparatus that do not cause the tearing of a diaphragm even if abnormal pressure is generated.

In order to achieve the object, according to an aspect of the invention, there is provided a liquid supply device comprising: an ink passage that allows an ink jet head, which ejects ink from nozzles, to communicate with an ink tank in which ink is stored; a pump that is provided on the ink passage and applies pressure to ink present in the ink passage; a back-pressure tank that is provided between the ink jet head and the pump and includes a liquid chamber communicating with the ink passage through a flow port, a gas chamber in which gas is stored, and an elastic diaphragm isolating the liquid chamber from the gas chamber; and a restriction member that is disposed on an extension surface of the flow port of an inner wall surface of the liquid chamber and keeps the elastic diaphragm on an inside of the extension surface in a case in which the elastic diaphragm is sucked into the flow port by the pressure that is applied to the ink by the pump.

According to this aspect, even if the elastic diaphragm is sucked into the flow port due to abnormal pressure, it is possible to keep the elastic diaphragm on the inside of the extension surface and to prevent the tearing of the elastic diaphragm. Here, "an extension surface of the flow port of an inner wall surface of the liquid chamber" means the inner wall surface of the liquid chamber that would be supposed to be present at a position of the opening of the flow port in a case in which the opening of the flow port were not formed on the liquid chamber, and is a virtual surface that has a shape continuing from the inner wall surface of a peripheral portion of the flow port.

It is preferable that the restriction member divides the flow port into a plurality of regions. Accordingly, it is possible to appropriately keep the elastic diaphragm on the inside of the extension surface of the inner wall surface of the liquid chamber.

It is preferable that the restriction member divides the flow port into a plurality of regions having a size determined on the basis of a tensile strength of the elastic diaphragm and the maximum pressure of the pump. Accordingly, it is possible to appropriately keep the elastic diaphragm on the inside of the extension surface of the inner wall surface of the liquid chamber.

The flow port may include a first flow port that communicates with the ink jet head through the ink passage and a second flow port that communicates with the pump through the ink passage. In this case, it is preferable that a first restriction member disposed at the first flow port divides the first flow port into a plurality of regions having the maximum size, which enables the elastic diaphragm to be kept on the inside of the extension surface, in a case in which the elastic diaphragm is sucked into the first flow port by the pressure that is applied to the ink by the pump. Accordingly, since a pressure loss can be reduced, the back-pressure tank can appropriately damp the pressure of the pump. Further, it is possible to appropriately keep the elastic diaphragm on the inside of the extension surface of the inner wall surface of the liquid chamber.

Furthermore, it is preferable that a second restriction member disposed at the second flow port divides the second flow port into a plurality of regions having the minimum size that enables ink to flow in the ink passage by the pressure that is applied to the ink by the pump. Accordingly, since ink present in the liquid chamber causes turbulence, it is possible to improve an effect of diffusing ink and to appropriately keep the elastic diaphragm on the inside of the extension surface of the inner wall surface of the liquid chamber.

It is preferable that the restriction member divides the flow port into a plurality of circular regions. Accordingly, a pressure loss can be reduced.

The liquid chamber may include a discharge port that communicates with the ink tank through a discharge passage.

It is preferable that the restriction member is formed integrally with the liquid chamber. Accordingly, it is not necessary to prepare a separate component and it is possible to appropriately set a position where the restriction member is disposed.

In order to achieve the object, according to another aspect of the invention, there is provided an image recording apparatus comprising: an ink tank in which ink is stored; an ink jet head that ejects ink from nozzles; a supply unit that uses a liquid supply device, is disposed between the ink tank and the ink jet head, and supplies the ink, which is stored in the ink tank, to the ink jet head; a moving unit that moves a recording medium relative to the ink jet head; and a recording control unit that records an image on a recording surface of the recording medium by ejecting ink from the nozzles of the ink jet head while relatively moving the recording medium. The liquid supply device comprises: an ink passage that allows the ink jet head, which ejects ink from the nozzles, to communicate with the ink tank in which ink is stored; a pump that is provided on the ink passage and applies pressure to ink present in the ink passage; a back-pressure tank that is provided between the ink jet head and the pump and includes a liquid chamber communicating with the ink passage through a flow port, a gas chamber in which gas is stored, and an elastic diaphragm isolating the liquid chamber from the gas chamber; and a restriction member that is disposed on an extension surface of the flow port of an inner wall surface of the liquid chamber and keeps the elastic diaphragm on an inside of the extension surface in a case in which the elastic diaphragm is sucked into the flow port by the pressure that is applied to the ink by the pump.

According to this aspect, since the pressure of the pump can be appropriately damped by the back-pressure tank, a high-quality image can be recorded.

The image recording apparatus may further comprise a recovery unit that uses a liquid supply device, is disposed between the ink jet head and the ink tank, and recovers the ink, which is supplied to the ink jet head, to the ink tank. The liquid supply device comprises: an ink passage that allows the ink jet head, which ejects ink from the nozzles, to communicate with the ink tank in which ink is stored; a pump that is provided on the ink passage and applies pressure to ink present in the ink passage; a back-pressure tank that is provided between the ink jet head and the pump and includes a liquid chamber communicating with the ink passage through a flow port, a gas chamber in which gas is stored, and an elastic diaphragm isolating the liquid chamber from the gas chamber; and a restriction member that is disposed on an extension surface of the flow port of an inner wall surface of the liquid chamber and keeps the elastic diaphragm on an inside of the extension surface in a case in which the elastic diaphragm is sucked into the flow port by the pressure that is applied to the ink by the pump. Accordingly, it is possible to circulate ink in the ink jet head.

According to the invention, it is possible to provide a liquid supply device and an image recording apparatus that can prevent the tearing of a diaphragm even if abnormal pressure is generated.

DESCRIPTION OF THE PREFERRED EMBODIMENTS

Preferred embodiments of the invention will be described in detail below with reference to accompanying drawings.

[Entire Configuration of Circulation Type Ink Supply Device]

An ink supply device 100 according to this embodiment is a circulation type liquid supply device that supplies ink, which is stored in an ink tank 52, to an ink jet head 50, which is an object to which ink is supplied, recovers ink, which is not used in the ink jet head 50, to an ink tank 52, and controls the internal pressure (back-pressure) of the ink jet head 50 by the amount of ink to be sent.

Figure 1:
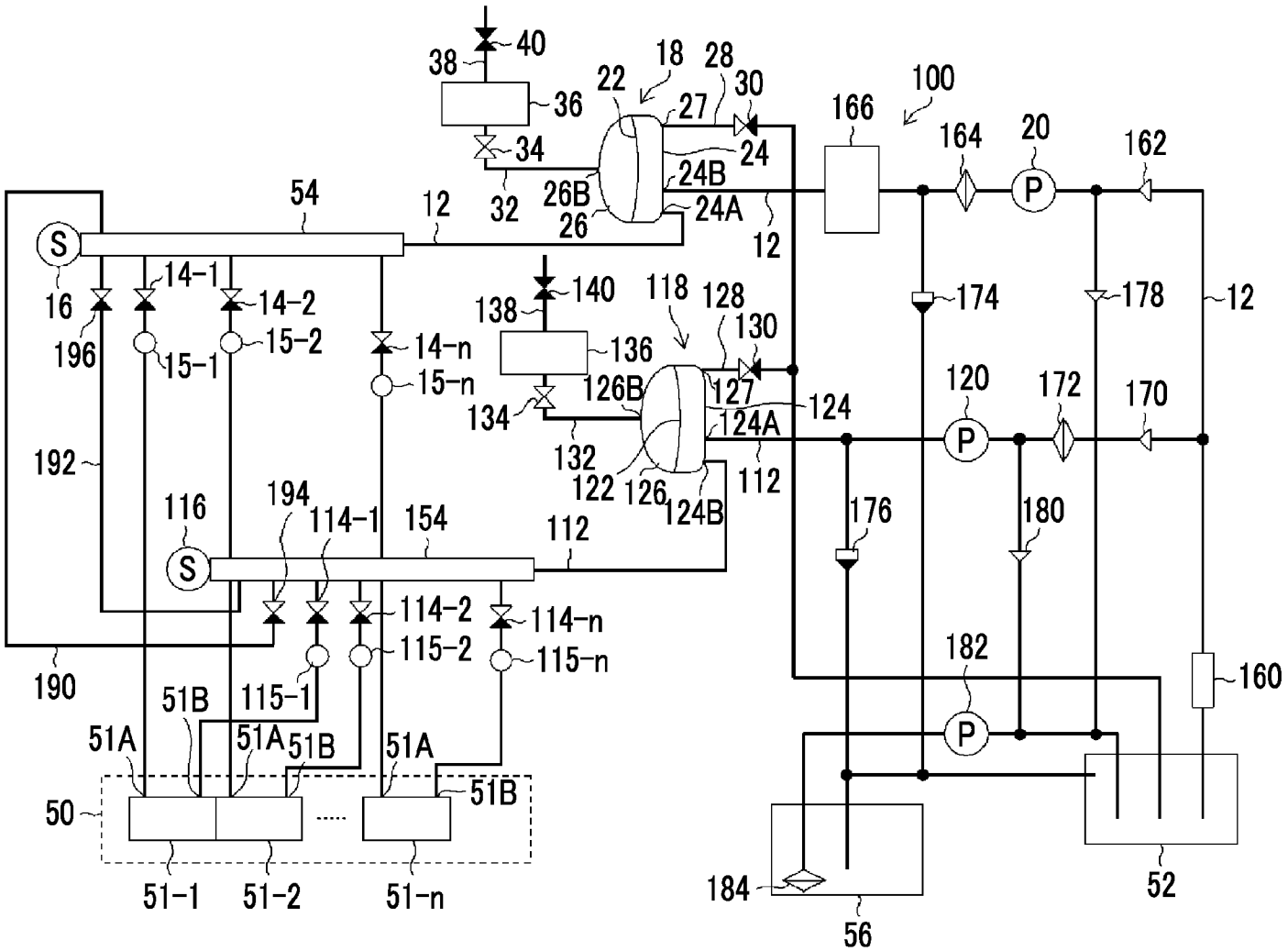
FIG. 1 is a block diagram showing the entire configuration of an ink supply device 100.

As shown in FIG. 1, the ink supply device 100 includes a supply passage 12 (an example of an ink passage) that allows the ink tank 52 and the ink jet head 50 to communicate with each other, and a recovery passage 112 that allows the ink jet head 50 and the ink tank 52 to communicate with each other.

A pressure sensor 16, a supply sub-tank 18, a supply pump 20, and the like are provided on the supply passage 12. Further, a pressure sensor 116, a recovery sub-tank 118, a recovery pump 120, and the like are provided on the recovery passage 112.

The ink jet head 50 is a head having a structure in which head modules 51-1, 51-2, . . . , **51-*n* each of which includes a plurality of nozzles ejecting ink are joined to each other. Each of the head modules 51 includes an ink supply port 51A and an ink discharge port 51B. The respective ink supply ports 51A of the head modules 51-1, 51-2, . . . , 51-*n* communicate with the supply passage 12 through supply valves 14-1, 14-2, . . . , 14-*n*, and the respective ink discharge ports 51B communicate with the recovery passage 112 through recovery valves 114-1, 114-2, . . . , 114-*n***.

The supply valve 14 is passage opening/closing unit that switches the communication and blocking of the supply passage 12, and the recovery valve 114 is passage opening/closing unit that switches the communication and blocking of the recovery passage 112. Since normally closed (or latching) solenoid valves of which the opening and closing are controlled by control signals are applied as the supply valve 14 and the recovery valve 114, the supply valve 14 and the recovery valve 114 are adapted so that ink does not leak out of the ink jet head 50 even if power is cut off in a case in which an emergency stop function is operated or the like.

Dampers 15-1, 15-2, . . . , **15-*n* are provided between the supply valves 14-1, 14-2, . . . , 14-*n* and the ink supply ports 51A, respectively. The damper 15 is a pressure damping unit that suppresses the pulsation of ink that occurs due to an ejection operation of the ink jet head 50**.

The pressure sensor 16 is a pressure measuring unit that measures and outputs the internal pressure of the supply passage 12, and the pressure sensor 116 is a pressure measuring unit that measures and outputs the internal pressure of the recovery passage 112. Sensors using a semiconductor piezoresistive method, a capacitive method, a silicon resonant method, and the like can be applied as the pressure sensors 16 and 116.

A supply-side manifold 54, which is a temporary storage portion for ink, is provided between the supply sub-tank 18 (an example of a back-pressure tank), which is provided on the supply passage 12, and the ink jet head 50 and a recovery-side manifold 154, which is a temporary storage portion for ink, is provided between the recovery sub-tank 118 (an example of a back-pressure tank), which is provided on the recovery passage 112, and the ink jet head 50. The supply-side manifold 54 and the recovery-side manifold 154 communicate with each other through bypass passages 190 and 192, and bypass passage valves 194 and 196 are provided on the bypass passages 190 and 192, respectively.

The supply pump 20 is a liquid pressure applying unit that applies pressure to the ink that is present in the supply passage 12, and the recovery pump 120 is a liquid pressure applying unit that applies pressure to the ink that is present in the recovery passage 112. Tube pumps are applied as the supply pump 20 and the recovery pump 120.

The supply pump 20 controls the pressure (the amount of ink to be sent) of the supply passage 12 that supplies ink to the ink jet head 50 from the ink tank 52, and the recovery pump 120 controls the pressure (the amount of ink to be sent) of the recovery passage 112 that recovers (circulates) the ink to the ink tank 52 from the ink jet head 50. Pumps having the same performance (capacity) can be applied as the supply pump 20 and the recovery pump 120.

The supply pump 20 and the recovery pump 120 are rotated in only one direction in a period in which the operation of the ink jet head 50 is stopped (that is, a period in which ink stably flows). When the internal pressure of the ink jet head 50 is reduced in a period in which the ink jet head 50 ejects ink from the nozzles, the supply pump 20 increases the rotational speed thereof and the recovery pump 120 is decelerated or is rotated in a reverse direction so that the internal pressure of the ink jet head 50 is increased.

That is, the driving of the supply pump 20 and the driving of the recovery pump 120 are controlled so that the internal pressure of the supply passage 12 becomes higher than the internal pressure of the recovery passage 112 and desired back-pressure (negative pressure) is applied to the ink present in the nozzles of the ink jet head 50.

The supply sub-tank 18 is a pressure damping unit that is provided between the supply pump 20 and the ink jet head 50 and adjusts pressure so as to suppress the fluctuation of the internal pressure of the supply passage 12. The supply sub-tank 18 includes an ink outlet 24A (an example of a first flow port), a liquid chamber 24 that communicates with the supply passage 12 through an ink inlet 24B (an example of a second flow port), a gas chamber 26 in which gas is stored, and an elastic diaphragm 22 that isolates the liquid chamber 24 from the gas chamber 26. The ink outlet 24A communicates with the ink jet head 50 through the supply passage 12 and the supply valve 14, and the ink inlet 24B communicates with the ink tank 52 through the supply passage 12 and the supply pump 20. Further, the supply sub-tank 18 includes a bubble discharge port 27 (an example of a third flow port), and the bubble discharge port 27 communicates with the ink tank 52 through a drain passage 28 and a drain valve 30.

When ink flows into the liquid chamber 24 from the ink inlet 24B, the elastic diaphragm 22 is deformed toward the gas chamber 26 according to the volume of the ink having flowed into the liquid chamber. Accordingly, the volume of ink, which flows out of the ink outlet 24A, is not changed. Therefore, it is possible to suppress the fluctuation of the pressure of the supply passage 12. That is, the supply sub-tank 18 has a pressure damping function to suppress the fluctuation of the internal pressure of the ink jet head 50 and the fluctuation of the internal pressure of the supply passage 12 that is caused by pulsating flow generated from the operation of the supply pump 20.

The drain passage 28 is a passage that is used to forcibly discharge ink present in the liquid chamber 24. When the drain valve 30 is opened, ink present in the liquid chamber 24 is sent to the ink tank 52.

Further, the supply sub-tank 18 comprises an air passage 32, an air-connection valve 34, an air tank 36, an atmosphere communication passage 38, and an air valve 40 as a gas-elasticity adjusting unit that determines the pressure-damping performance of the supply sub-tank 18.

The gas chamber 26 of the supply sub-tank 18 is provided with an air passage-communication port 26B that communicates with the air passage 32. The air-connection valve 34 is air passage opening/closing unit that switches the communication and blocking of the air passage 32, and the gas chamber 26 communicates with the air tank 36 through the air-connection valve 34.

Furthermore, the air valve 40 for switching the communication and blocking of the atmosphere communication passage 38 is provided on the atmosphere communication passage 38, and the air tank 36 communicates with the atmosphere through the atmosphere communication passage 38.

A normally open solenoid valve is used as the air-connection valve 34. Moreover, since a normally closed solenoid valve is applied as the air valve 40, the air valve 40 is adapted so that ink does not leak out of the ink jet head 50 even if power is cut off in a case in which an emergency stop function is operated or the like.

When the air-connection valve 34 is opened, the gas chamber 26 communicates with the air tank 36 and the volume of the gas chamber 26 can be increased according to the control of the pressure of ink to be sent. In addition, it is possible to allow the air tank 36 and the gas chamber 26 to communicate with the atmosphere by opening the air valve 40. The air tank 36 functions as a buffer tank of the gas chamber 26.

Meanwhile, the recovery sub-tank 118 is a pressure damping unit that is provided between the ink jet head 50 and the recovery pump 120 and adjusts pressure so as to suppress the fluctuation of the internal pressure of the recovery passage 112. The recovery sub-tank 118 has the same structure as the supply sub-tank 18. That is, the recovery sub-tank 118 includes an ink outlet 124A, a liquid chamber 124 that communicates with the recovery passage 112 through an ink inlet 124B (an example of a flow port), a gas chamber 126 in which gas is stored, and an elastic diaphragm 122 that isolates the liquid chamber 124 from the gas chamber 126. The ink inlet 124B communicates with the ink jet head 50 through the recovery valve 114, and the ink outlet 124A communicates with the ink tank 52 through the recovery pump 120. Further, the recovery sub-tank 118 includes a bubble discharge port 127, and the bubble discharge port 127 communicates with the ink tank 52 through a drain passage 128 and a drain valve 130.

Furthermore, the recovery sub-tank 118 comprises an air passage 132, an air-connection valve 134, an air tank 136, an atmosphere communication passage 138, and an air valve 140 as a gas-elasticity adjusting unit that determines the pressure-damping performance of the recovery sub-tank 118; and acts in the same manner as the gas-elasticity adjusting unit of the supply sub-tank 18.

The ink tank 52 is an ink storage unit in which ink to be supplied to the ink jet head 50 ejecting ink from the nozzles is stored. The ink, which is stored in the ink tank 52, is supplied to the ink jet head 50 through the supply sub-tank 18 and the supply valve 14 by the supply pump 20. Further, ink, which is not used in the ink jet head 50, is recovered to the ink tank 52 through the recovery valve 114 and the recovery sub-tank 118 by the recovery pump 120.

In the ink supply device 100, a deaeration module 160 and a one-way valve 162 for preventing the backflow of ink are provided between the ink tank 52 and the supply pump 20 and a filter 164 and a heat exchanger 166 are provided between the supply pump 20 and the supply sub-tank 18. Ink, which is sent from the ink tank 52, is subjected to deaeration by the deaeration module 160, bubbles and foreign materials are removed from the ink by the filter 164, and the ink is sent to the supply sub-tank 18 after the temperature of the ink is adjusted by the heat exchanger 166.

Furthermore, a one-way valve 170 for preventing the backflow of ink and a filter 172 are provided between the deaeration module 160 and the recovery pump 120. Predetermined deaeration and filtering are also performed in a case in which ink is sent to the recovery sub-tank 118 from the ink tank 52.

In addition, the ink supply device 100 comprises safety valves (relief valves) 174 and 176. In a case in which abnormality is generated in the supply pump 20 and the recovery pump 120 and the internal pressure of the supply passage 12 and the internal pressure of recovery passage 112 are higher than a predetermined value, the safety valves 174 and 176 of the ink supply device 100 are operated to lower the internal pressure of the supply passage 12 and the internal pressure of the recovery passage 112. The ink supply device 100 further comprises one-way valves 178 and 180 that prevent the backflow of ink during the reverse operation of the supply pump 20 and the recovery pump 120.

Ink to be supplied to the ink tank 52 is stored in a main tank 56. When the amount of ink stored in the ink tank 52 is reduced, the ink supply device 100 operates a replenishment pump 182 to send the ink, which is stored in the main tank 56, to the ink tank 52. A filter 184 is provided in the main tank 56.

The ink supply device 100 having the above-mentioned configuration circulates ink by generating differential pressure between the supply-side manifold 54 and the recovery-side manifold 154 through the operation of the supply pump 20 and the recovery pump 120. For example, when negative pressure is generated in the supply-side manifold 54 by the normal operation of the supply pump 20 and negative pressure lower than the negative pressure, which is generated on the supply side, is generated in the recovery-side manifold 154 by the reverse operation of the recovery pump 120 in a state in which the supply valve 14 and the recovery valve 114 are opened, ink flows to the recovery-side manifold 154 from the supply-side manifold 54 through the ink jet head 50 and ink can be circulated through the recovery passage 112, the recovery sub-tank 118, and the like.

When ink is to be circulated, the second bypass passage valve 196 provided on the second bypass passage 192 may be opened and the supply-side manifold 54 and the recovery-side manifold 154 may communicate with each other through the second bypass passage 192. Meanwhile, as long as the bypass passages 190 and 192 have diameters that do not allow a pressure loss to be generated during the application of pressure, either of the bypass passages 190 and 192 may be provided.

[Structure of supply sub-tank and recovery sub-tank]

Next, the structure of the supply sub-tank 18 and the recovery sub-tank 118 will be described. Since the supply sub-tank 18 and the recovery sub-tank 118 have the same structure, the structure of the supply sub-tank 18 will be representatively described here.

Figure 2:
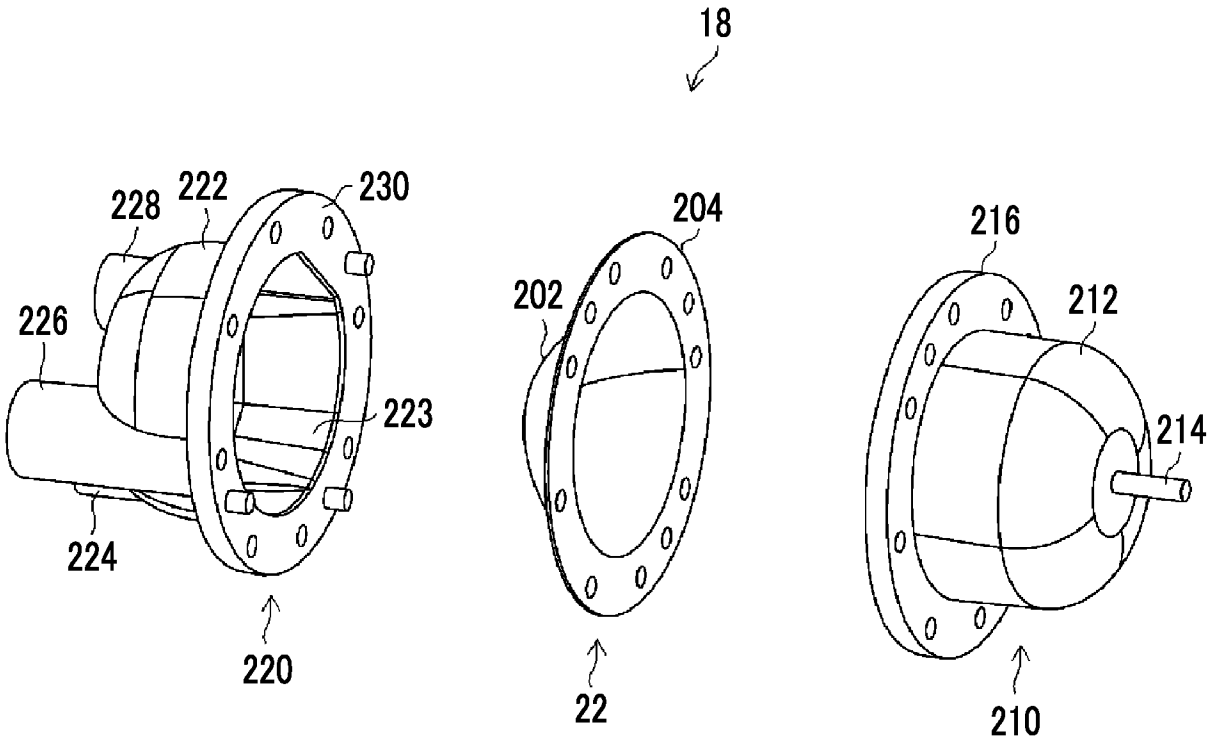
FIG. 2 is an exploded view showing an example of the structure of a supply sub-tank 18.

As shown in FIG. 2, the supply sub-tank 18 includes the elastic diaphragm 22, a gas chamber-side tank frame 210, and a liquid chamber-side tank frame 220.

The elastic diaphragm 22 includes a dome portion 202 and a flange portion 204. Since the dome portion 202 has the shape of a dome that is convex toward the liquid chamber-side tank frame 220, the dome portion 202 improves pressure-damping performance in the supply of ink in a state in which the inside of the liquid chamber 24, particularly, is kept at a negative pressure. Further, eleven hole portions are formed at the flange portion 204.

A material, which has good moldability, low gas permeability, and a good chemical liquid contact property between itself and liquid, is selected as the material of the elastic diaphragm 22. Here, a material having a good chemical liquid contact property means a chemically stable material, that is, a material which is not deformed (dissolved or swelled) by the contact between itself and liquid or of which physical properties are not changed. Furthermore, in order to achieve desired pressure-damping performance, the material needs to be a material which is flexible and of which the shape is easily deformed. Specifically, examples of the material of the elastic diaphragm 22 include a thermoplastic elastomer. Here, a styrene thermoplastic elastomer is used. More specifically, the elastic diaphragm 22 is made of EARNESTON SH50NS that is manufactured by Kuraray Plastics Co., Ltd. Meanwhile, the elastic diaphragm 22 is not limited to a thermoplastic elastomer, and may be made of vulcanized rubber.

The gas chamber-side tank frame 210 includes a storage portion 212, a pipe portion 214, and a flange portion 216. The storage portion 212 forms a gas chamber 26 (see FIG. 1) therein. The inner wall surface of the storage portion 212 is formed in a shape that receives the dome shape of the elastic diaphragm 22, and a pipe portion 214, which communicates with the air passage-communication port 26B (see FIG. 1), is provided on the storage portion 212 at a position corresponding to the apex of the storage portion 212. Further, eleven hole portions are formed at the flange portion 216.

The liquid chamber-side tank frame 220 includes a storage portion 222, branch pipe portions 224, 226, and 228, and a flange portion 230. The storage portion 222 forms a liquid chamber 24 (see FIG. 1) therein. An inner wall surface 223 of the storage portion 222 is formed in a shape that receives the dome shape of the elastic diaphragm 22, and the ink outlet 24A, the ink inlet 24B, and the bubble discharge port 27 (see FIG. 1) are opened to the inner wall surface 223. The storage portion 222 is provided with the branch pipe portions 224, 226, and 228, and the storage portion 222 communicates with the branch pipe portions 224, 226, and 228 through the ink outlet 24A, the ink inlet 24B, and the bubble discharge port 27, respectively. Furthermore, eight hole portions and three protrusion portions are formed at the flange portion 230.

The three protrusion portions of the flange portion 230 of the liquid chamber-side tank frame 220 are inserted into the three hole portions among the eleven hole portions of the flange portion 204 of the elastic diaphragm 22, so that the elastic diaphragm 22 is positioned relative to the liquid chamber-side tank frame 220. Further, bolts (not shown) are inserted into the eight hole portions of each of the flange portion 216 of the gas chamber-side tank frame 210, the flange portion 204 of the elastic diaphragm 22, and the flange portion 230 of the liquid chamber-side tank frame 220 and the flange portions are fixed to one another, so that the supply sub-tank 18 is formed.

Figure 3A:
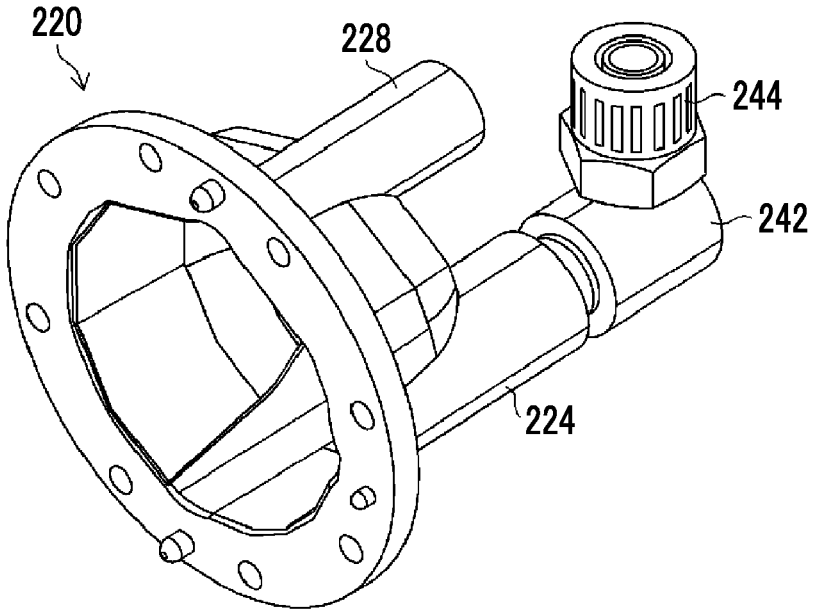
FIGS. 3A and 3B are perspective views of a liquid chamber-side tank frame 220 of this embodiment.

As shown in FIG. 3A, one end of a joint 242 is inserted into the branch pipe portion 224. A bolt 244 is provided at the other end of the joint 242, and a tube (not shown), which forms the supply passage 12, is connected to the bolt 244. Although not shown in FIG. 3A, joint are inserted into the branch pipe portions 226 and 228 likewise and tubes, which form the supply passage 12 and the drain passage 28, are connected to the joints, respectively.

Figure 3B:
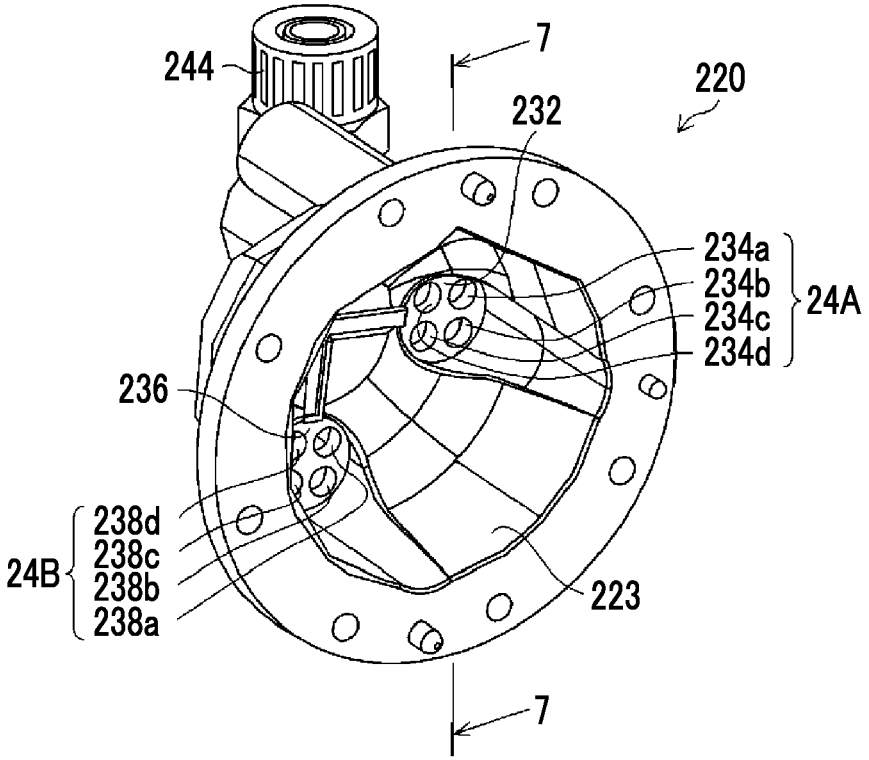
Figure 4A:
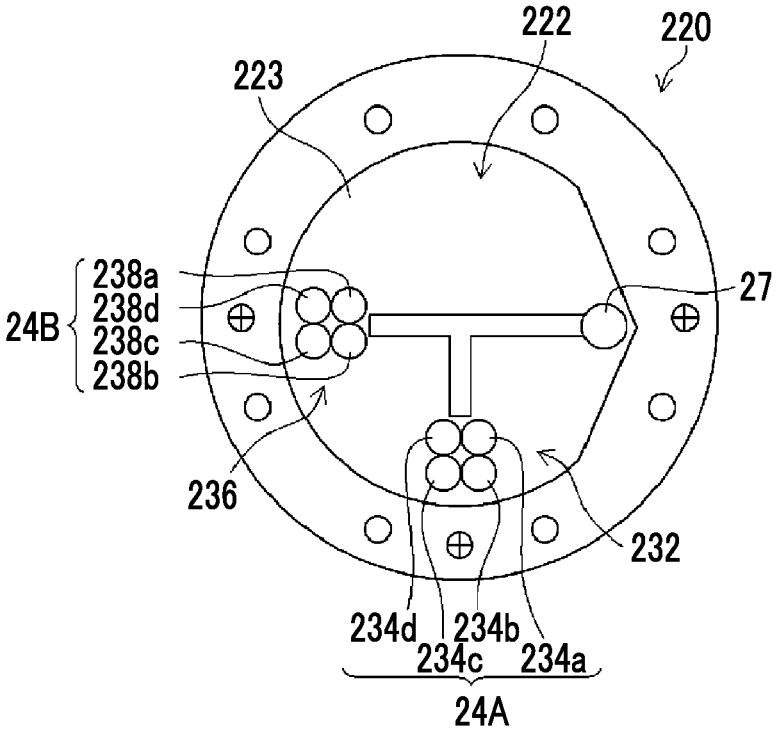
FIG. 4A is a front view of the liquid chamber-side tank frame 220 of this embodiment that is viewed from the inside of a storage portion 222.
Figure 4B:
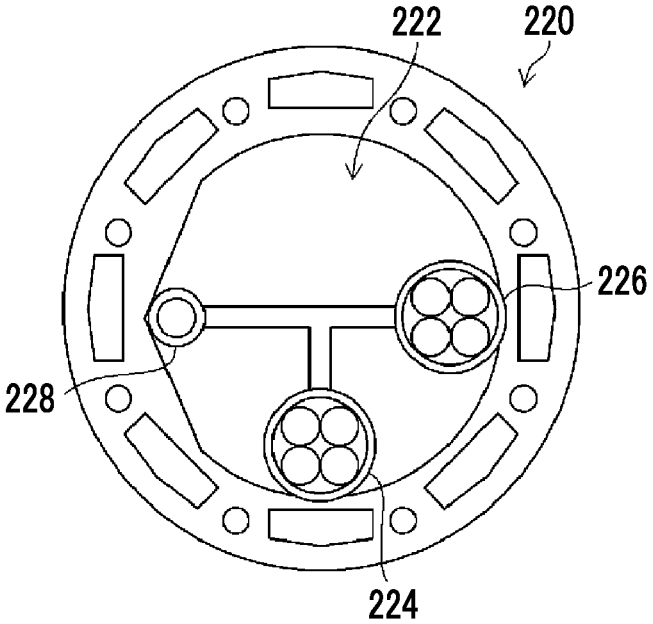
FIG. 4B is a rear view of the liquid chamber-side tank frame 220 of this embodiment that is viewed from branch pipe portions 224, 226, and 228 of the storage portion 222.

As shown in FIG. 3B and FIGS. 4A and 4B, a restriction part 232 (an example of a first restriction member), which is formed integrally with the gas chamber-side tank frame 210, is disposed at the ink outlet 24A. The restriction part 232 is a member that divides the ink outlet 24A into a plurality of regions, and the ink outlet 24A is divided into four regions 234*a*, 234*b*, 234*c*, and 234*d* by the restriction part 232. Likewise, a restriction part 236 (an example of a second restriction member), which is formed integrally with the gas chamber-side tank frame 210, is disposed at the ink inlet 24B, and the ink inlet 24B is divided into four regions 238*a*, 238*b*, 238*c*, and 238*d* by the restriction part 236.

A restriction part is not provided at the bubble discharge port 27 in this embodiment, but a restriction part may also be provided at the bubble discharge port 27 and the bubble discharge port 27 may be divided into a plurality of regions.

[Shape of Elastic Diaphragm During Generation of Abnormal Pressure]

Figure 5A:
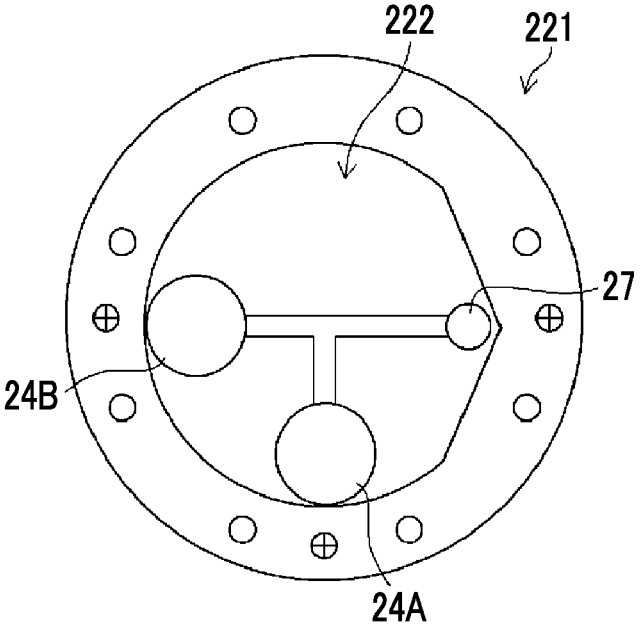
FIG. 5A is a front view of a liquid chamber-side tank frame 221 that is not provided with a restriction part.
Figure 5B:
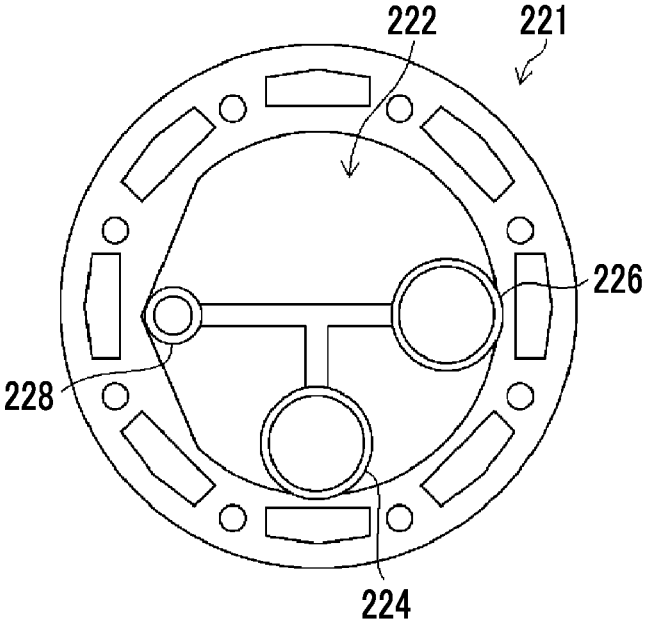
FIG. 5B is a rear view of the liquid chamber-side tank frame 221 that is not provided with the restriction part.

A liquid chamber-side tank frame 221, which is shown in FIGS. 5A and 5B and is not provided with restriction parts, is different from the liquid chamber-side tank frame 220 of this embodiment in that the liquid chamber-side tank frame 221 is not provided with the restriction parts 232 and 236.

Figure 6:
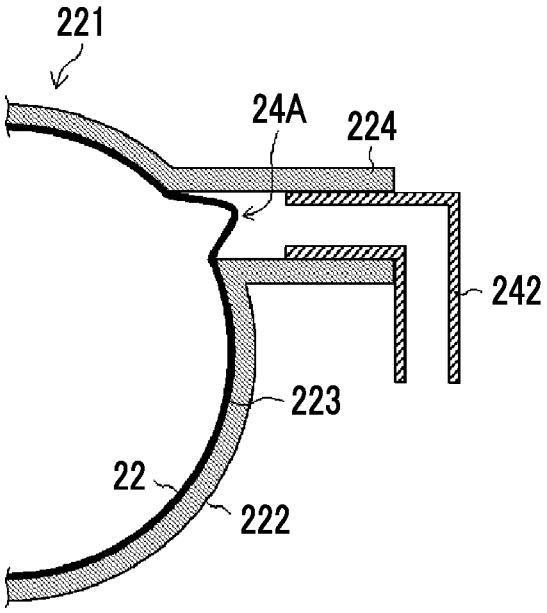
FIG. 6 is a view showing the aspect of an elastic diaphragm 22 in a case in which the liquid chamber-side tank frame 221 not provided with a restriction part is used and operational abnormality occurs in a recovery pump 120.

A case in which the liquid chamber-side tank frame 221 not provided with the restriction parts is used for the supply sub-tank 18 shown in FIG. 1 is considered. When operational abnormality occurs in the recovery pump 120 and abnormal pressure is generated in the liquid chamber 24, the elastic diaphragm 22 sticks to an inner wall surface 223 of a storage portion 222 of the liquid chamber-side tank frame 221 not provided with the restriction parts as shown in FIG. 6. In addition, the elastic diaphragm 22 is sucked to the outside of an extension surface 223A (see FIGS. 8A, 8B, and 8C) of the inner wall surface 223 from the ink outlet 24A. Here, the extension surface 223A is a surface that is supposed to be present at a position of the opening of the ink outlet 24A in a case in which the ink outlet 24A is not present on the liquid chamber 24, and is a virtual surface that has a shape continuing from the inner wall surface 223 of a peripheral portion of the ink outlet 24A. As a result, the shape of a protrusion is formed. There is a problem in that the elastic diaphragm 22 may be torn when the elastic diaphragm 22 is partially stretched.

Figure 7:
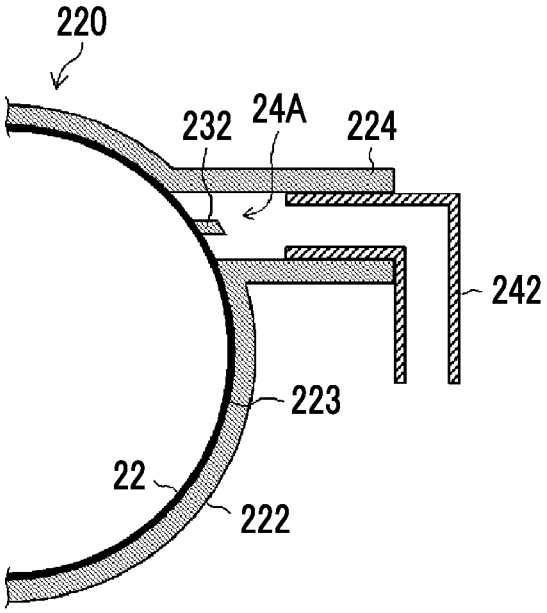
FIG. 7 is a cross-sectional view taken along line 7-7 of FIG. 3B and showing the aspect of the elastic diaphragm 22 in a case in which the liquid chamber-side tank frame 220 is used and operational abnormality occurs in the recovery pump 120.

In contrast, the restriction part 232 is provided on the liquid chamber-side tank frame 220 of this embodiment and the ink outlet 24A is divided into the four regions 234*a*, 234*b*, 234*c*, and 234*d*. Even if the operational abnormality of the recovery pump 120 occurs and abnormal pressure is generated in the liquid chamber 24 in a case in which the liquid chamber-side tank frame 220 of this embodiment is used for the supply sub-tank 18, the elastic diaphragm 22 sticks to the inner wall surface 223 of the storage portion 222 as shown in FIG. 7 but the restriction part 232 serves as a stopper. For this reason, since the elastic diaphragm 22 is kept on the inside of the extension surface 223A of the inner wall surface 223 without being sucked into (the respective regions 234*a*, 234*b*, 234*c*, and 234*d* of) the ink outlet 24A, the shape of a protrusion is not formed.

Figure 8A:
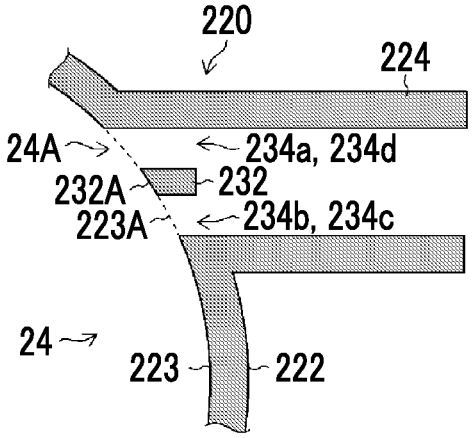
FIGS. 8A, 8B, and 8C are views showing the disposition of a restriction part 232 at an ink outlet 24A.

Since a surface 232A of the restriction part 232 facing the liquid chamber 24 is disposed along the extension surface 223A of the inner wall surface 223 of the liquid chamber 24 in the ink outlet 24A as shown in FIG. 8A, the elastic diaphragm 22 is kept in a shape along the extension surface 223A of the inner wall surface 223 in a case in which the elastic diaphragm 22 is sucked into the ink outlet 24A.

Here, the shape along the extension surface 223A of the inner wall surface 223 means a shape where the shape of a protrusion shown in FIG. 6 is not formed at the elastic diaphragm 22, and also include a shape, which is substantially along the extension surface 223A so as not to allow a damage to the elastic diaphragm 22 without being limited to a shape correctly along the extension surface 223A.

Figure 8B:
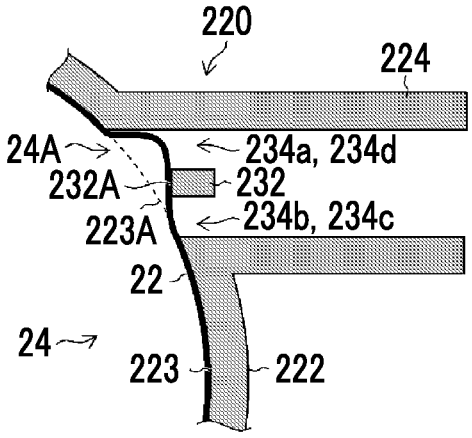

For example, FIG. 8B shows an aspect where the elastic diaphragm 22 is sucked into the ink outlet 24A in a case in which the restriction part 232 is disposed at a position where the surface 232A is positioned on the outer side of the ink outlet 24A than the extension surface 223A. Even if the elastic diaphragm 22 is sucked to the outside of the extension surface 223A when being sucked from the ink outlet 24A as described above, the elastic diaphragm 22 has a shape substantially along the extension surface 223A and the restriction part 232 only has to be disposed at a position where the elastic diaphragm 22 is not damaged.

Figure 8C:
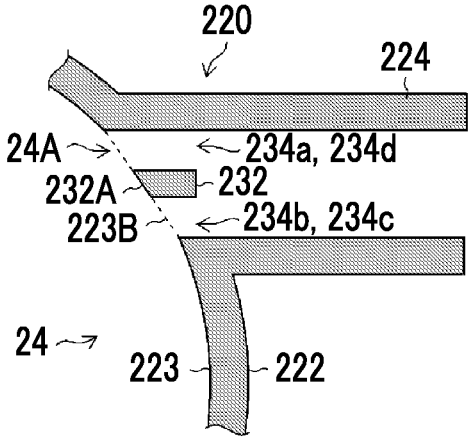

Further, as shown in FIG. 8C, the surface 232A of the restriction part 232 facing the liquid chamber 24 may be disposed along a flat surface 223B connecting the peripheral portions of the ink outlet 24A. Accordingly, since the elastic diaphragm 22 can be kept in a shape along the flat surface 223B connecting the peripheral portions of the ink outlet 24A in a case in which the elastic diaphragm 22 is sucked into the ink outlet 24A, the elastic diaphragm 22 has a shape substantially along the extension surface 223A. Accordingly, the elastic diaphragm 22 can be kept on the inside of the extension surface 223A of the inner wall surface 223.

According to the liquid chamber-side tank frame 220 of this embodiment, since the shape of a protrusion is not formed on the elastic diaphragm 22 in the ink outlet 24A as described above, the tearing of the elastic diaphragm 22 can be prevented.

[Relationship Between Size of Divided Region and Tensile Strength of Elastic Diaphragm]

Here, the restriction part 232 divides the ink outlet 24A into the regions 234*a*, 234*b*, 234*c*, and 234*d* having a size that is determined on the basis of the tensile strength of the elastic diaphragm 22 and the maximum pressure of the recovery pump 120.

Figures 9, 10:
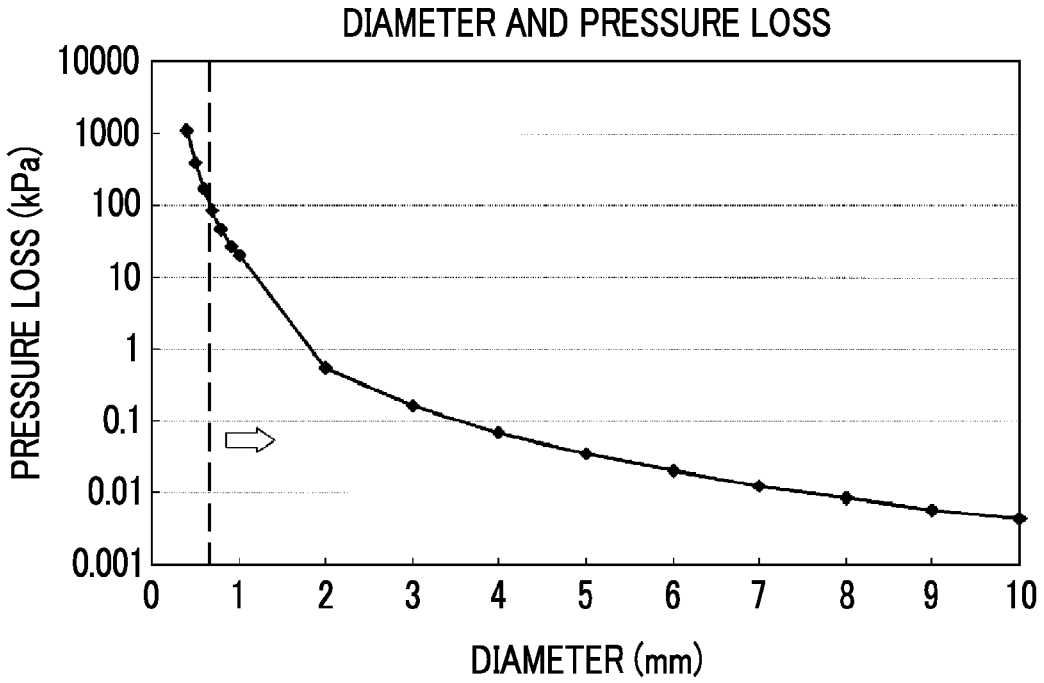
FIG. 9 is a view showing the sizes of regions 234*a*, 234*b*, 234*c*, and 234*d* and the presence or absence of the suction of the elastic diaphragm 22 at each tensile strength of the elastic diaphragm 22 in a case in which liquid chamber 24 is sucked in at the maximum pressure applied by the recovery pump 120.
FIG. 10 is a view showing a relationship between the diameter of each of the regions 234*a*, 234*b*, 234*c*, and 234*d* and a pressure loss at the ink outlet 24A.

In FIG. 9, the maximum pressure of the recovery pump 120 is set to −100 kPa, the condition of the diameter of each of the regions 234*a*, 234*b*, 234*c*, and 234*d* is classified into large (12.0 mm), medium (9.0 mm), and small (3.5 mm), and the condition of the tensile strength of the elastic diaphragm 22 is classified into high (15.0 MPa), medium (7.6 MPa), and low (3.0 MPa); and a combination where the elastic diaphragm 22 is not sucked into the ink outlet 24A is denoted by "A" and a combination where the elastic diaphragm 22 is sucked into the ink outlet 24A is denoted by "B", among combinations of the conditions. The tensile strength of the elastic diaphragm is a value that is determined from the physical properties of the diaphragm. Here, the tensile strength is a value that is measured using a test method of JISK6251 in a state in which the thickness of the elastic diaphragm 22 is set to 2 mm.

As shown in FIG. 9, the elastic diaphragm 22 having high tensile strength is sucked into the ink outlet in a case in which the diameter of each of the regions is large, but is not sucked into the ink outlet in cases in which the diameter of each of the regions is medium and small. Further, the elastic diaphragm 22 having medium tensile strength is sucked into the ink outlet in cases in which the diameter of each of the regions is large and medium, but is not sucked into the ink outlet in a case in which the diameter of each of the regions is small. Furthermore, the elastic diaphragm 22 having low tensile strength is sucked into the ink outlet in cases in which the diameter of each of the regions is large, medium, and small.

Meanwhile, when paying attention to the diameter of each of the regions, all the elastic diaphragm 22 having tensile strength are sucked into the ink outlet 24A in a case in which the diameter of each of the regions 234*a*, 234*b*, 234*c*, and 234*d* is large. Further, in a case in which the diameter of each of the regions is medium, the elastic diaphragm having high tensile strength is not sucked into the ink outlet and the elastic diaphragm having medium tensile strength and the elastic diaphragm having low tensile strength are sucked into the ink outlet. Furthermore, when the diameter of each of the regions is small, the elastic diaphragm having high tensile strength and the elastic diaphragm having medium tensile strength are not sucked into the ink outlet and the elastic diaphragm having low tensile strength is sucked into the ink outlet.

As described above, the elastic diaphragm 22 having high tensile strength is difficult to be sucked into the ink outlet 24A. Further, the elastic diaphragm 22 is difficult to be sucked into the ink outlet 24A of which the diameter of each of the regions 234*a*, 234*b*, 234*c*, and 234*d* is small. However, when the diameter of each of the regions is too small, a pressure loss is increased. For this reason, there is a concern that ink may not be circulated.

Since a pressure loss at the ink outlet 24A exceeds 100 kPa when the diameter of each of the regions 234*a*, 234*b*, 234*c*, and 234*d* is smaller than 0.7 mm as shown in FIG. 10, it is supposed that ink is not circulated. Accordingly, it is preferable that the diameter of each of the regions is 0.7 mm or more.

Therefore, on the basis of the fluctuation of the pressure of the recovery pump 120, it is possible to experimentally determine the size of each of the regions of the ink outlet 24A from the tensile strength of the elastic diaphragm 22 in a range where the supply sub-tank 18 can keep appropriate pressure-damping performance. In this embodiment, the diameter of each of the regions 234*a*, 234*b*, 234*c*, and 234*d* is set to 3.5 mm and the tensile strength of the elastic diaphragm 22 is set to 7.6 MPa.

[Other Shapes of Divided Region]

Figure 11A:
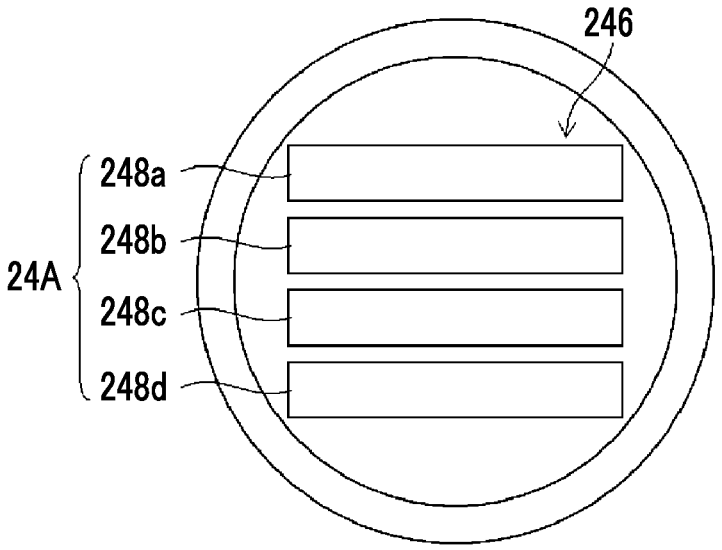
FIGS. 11A and 11B are views showing other shapes of divided regions of the ink outlet 24A.

An example in which the ink outlet 24A is divided into four circular (hole) regions 234*a*, 234*b*, 234*c*, and 234*d* by the restriction part 232 has been described until now, but the shape of the divided region is not limited to a circular shape. Considering a pressure loss, it is preferable that the ink outlet 24A is divided into circular regions. However, for example, the ink outlet 24A may also be divided into four rectangular regions 248*a*, 248*b*, 248*c*, and 248*d* by a restriction part 246 as shown in FIG. 11A. Further, the number of divided regions is also not limited to four. Even in a case in which the ink outlet 24A is divided into regions having a shape other than a circular shape, it is possible to divide the ink outlet 24A into regions, which have an appropriate size, by experimentally obtaining a relationship between the size of the divided region and the tensile strength of the elastic diaphragm.

Figure 11B:
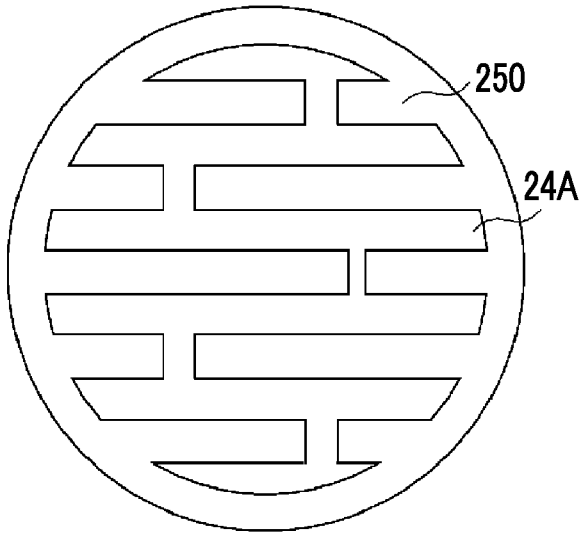

Furthermore, the invention is not limited to an aspect where the ink outlet 24A is divided into a plurality of regions. For example, the ink outlet 24A may be restricted as a single region by a restriction part 250 as shown in FIG. 11B.

In each of the cases, each of the restriction parts 246 and 250 is formed integrally with the gas chamber-side tank frame 210 and is disposed on the extension surface 223A of the ink outlet 24A of the inner wall surface 223 of the liquid chamber 24.

When the restriction part is formed as described above, an effect of preventing the suction of the elastic diaphragm 22 into the ink outlet 24A is obtained even if abnormal pressure is generated in the liquid chamber 24 due to the abnormal operation of the recovery pump 120. Moreover, when the elastic diaphragm 22 sticks to the inner wall surface 223 of the storage portion 222 of the liquid chamber-side tank frame 220, an effect of easily peeling the elastic diaphragm 22 from the inner wall surface 223 is obtained.

[Relationship Between Ink Outlet and Ink Inlet]

Details of the ink outlet 24A have been described until now, but the ink inlet 24B may also be formed so as to have the same structure. That is, the restriction part 236 is formed integrally with the gas chamber-side tank frame 210, and the surface of the restriction part 236 facing the liquid chamber 24 is disposed along the extension surface 223A (see FIG. 8A) of the ink inlet 24B of the inner wall surface 223 of the liquid chamber 24. The surface of the restriction part 236 facing the liquid chamber 24 may be disposed along a flat surface 223B (see FIG. 8C) connecting the peripheral portions of the ink inlet 24B. Accordingly, even if the operational abnormality of the supply pump 20 occurs and abnormal pressure is generated in the liquid chamber 24, the restriction part 236 serves as a stopper. For this reason, the elastic diaphragm 22 is kept on the inside of the extension surface of the inner wall surface 223 without being sucked into the ink inlet 24B. As described above, the shape of a protrusion is also not formed on the elastic diaphragm 22 in the ink inlet 24B.

Here, the areas of the regions, which are divided by the restriction parts 232 and 236, of the ink outlet 24A and the ink inlet 24B may be different from each other. Since the ink outlet 24A is sensitive to the fluctuation of pressure, it is preferable that resistance (a pressure loss) at the ink outlet 24A is small. There is no problem even if resistance at the ink inlet 24B is larger than resistance at the ink outlet 24A.

That is, in a case in which the elastic diaphragm 22 is sucked with abnormal pressure by the recovery pump 120, each of the regions 234*a*, 234*b*, 234*c*, and 234*d* of the ink outlet 24A needs to have the maximum area that enables the elastic diaphragm 22 to be kept on the inside of the extension surface 223A of the inner wall surface 223. Meanwhile, each of the regions 238*a*, 238*b*, 238*c*, and 238*d* of the ink inlet 24B may have the minimum area that enables ink to flow in the supply passage 12 by pressure that is applied to ink present in the supply passage 12 by the supply pump 20. When the areas of the regions 238*a*, 238*b*, 238*c*, and 238*d* are made to be smaller than the areas of the regions 234*a*, 234*b*, 234*c*, and 234*d*, ink present in the liquid chamber 24 causes turbulence. As a result, an effect of diffusing ink (heat diffusion, diffusion of deaeration degree) can be improved.

In contrast, since the ink inlet 124B is sensitive to the fluctuation of pressure, it is preferable that resistance (a pressure loss) at the ink inlet 124B is small in the recovery sub-tank 118. There is no problem even if resistance at the ink outlet 124A is larger than resistance at the ink inlet 124B. Accordingly, in a case in which the elastic diaphragm 122 is sucked with abnormal pressure by the supply pump 20, the ink inlet 124B may be divided into regions having the maximum area that does not allow the elastic diaphragm 122 to be sucked and the ink outlet 124A may be divided into regions having the minimum area that enables ink to flow in the recovery passage 112 by the recovery pump 120.

Further, when the ink outlet 24A and the ink inlet 24B are divided into a plurality of regions, an effect of trapping foreign materials, bubbles, and the like is also obtained in the normal circulation of ink

[Entire Configuration of Ink Jet Recording Apparatus]

Figure 12:
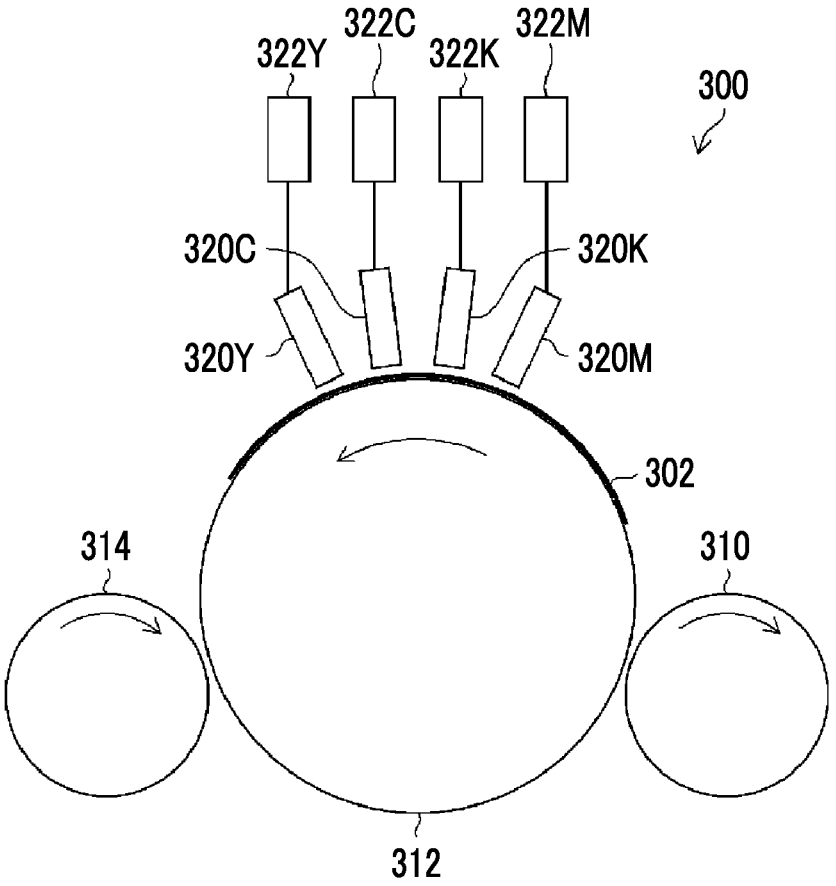
FIG. 12 is a view showing the entire configuration of an ink jet recording apparatus 300.

Next, an ink jet recording apparatus to which the ink supply device 100 is applied will be described. An ink jet recording apparatus 300 (an example of an image recording apparatus) shown in FIG. 12 includes: drums 310, 312, and 314; ink jet heads 320M, 320K, 320C, and 320Y; and ink supply devices 322M, 322K, 322C, and 322Y.

Each of the drums 310, 312, and 314 (an example of moving unit) has the shape of a cylinder that is rotatably supported. The drum 310 conveys (an example of "moves") a sheet 302, which is a sheet-shaped recording medium fed from a sheet feed unit (not shown), while holding the sheet 302 on the outer peripheral surface thereof; and delivers the sheet 302 to the drum 312. The drum 312 receives the sheet 302 from the drum 310, conveys the sheet 302 while holding the sheet 302 on the outer peripheral surface thereof, and delivers the sheet 302 to the drum 314. The drum 314 receives the sheet 302 from the drum 312, conveys the sheet 302 while holding the sheet 302 on the outer peripheral surface thereof, and delivers the sheet 302 to a sheet discharge unit (not shown).

The ink jet heads 320M, 320K, 320C, and 320Y eject four color inks, which correspond to magenta (M), black (K), cyan (C), and yellow (Y), to the recording surface of the sheet 302 that is conveyed by the drum 312; and records images on the recording surface of the sheet 302.

The ink supply devices 322M, 322K, 322C, and 322Y supply the color inks to the ink jet heads 320M, 320K, 320C, and 320Y (an example of supply unit); recovers the inks, which are not used in the ink jet heads 320M, 320K, 320C, and 320Y (an example of recovery unit); and circulate the inks, respectively. The ink supply device 100 can be applied as each of the ink supply devices 322M, 322K, 322C, and 322Y.

That is, the ink supply devices 322M, 322K, 322C, and 322Y comprises: ink tanks in which the respective color inks are stored; supply passages and recovery passages that allow the ink jet heads 320M, 320K, 320C, and 320Y to communicate with the ink tanks; supply pumps that apply pressure to the inks present in the supply passages; recovery pumps that apply pressure to the inks present in the recovery passages; supply sub-tanks that are provided between the ink jet heads 320M, 320K, 320C, and 320Y and the supply pumps and include liquid chambers communicating with the supply passages through flow ports, gas chambers in which gas is stored, and elastic diaphragm isolating the liquid chambers from the gas chambers; and recovery sub-tanks that are provided between the ink jet heads 320M, 320K, 320C, and 320Y and the recovery pumps and include liquid chambers communicating with the recovery passages through flow ports, gas chambers in which gas is stored, and elastic diaphragm isolating the liquid chambers from the gas chambers. Restriction members, which are disposed in the flow ports on extension surfaces of inner wall surfaces of the liquid chambers and keep the elastic diaphragm in shapes along the extension surfaces in a case in which the elastic diaphragm are sucked into the flow ports by the pressure applied to the inks by the supply pumps and the recovery pumps, are provided at the flow ports of the supply sub-tanks and the recovery sub-tanks.

[Electrical Configuration of Ink Jet Recording Apparatus]

Figure 13:
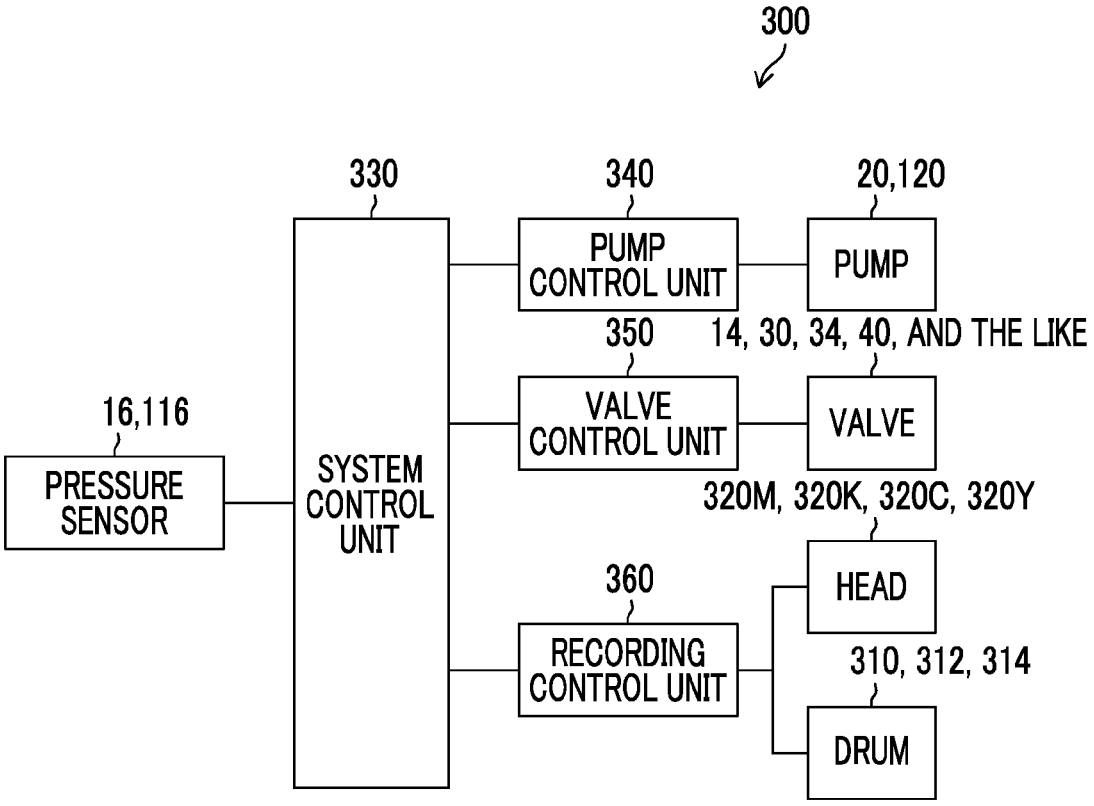
FIG. 13 is a block diagram showing the electrical configuration of the ink jet recording apparatus 300.

As shown in FIG. 13, the ink jet recording apparatus 300 includes a system control unit 330, a pump control unit 340, a valve control unit 350, and a recording control unit 360.

The system control unit 330 functions as a control unit that integrally controls each component of the ink jet recording apparatus 300. Measurement results of the pressure sensors 16 and 116 (see FIG. 1) of the ink supply devices 322M, 322K, 322C, and 322Y are input to the system control unit 330.

The pump control unit 340 controls the supply pumps 20 and the recovery pumps 120 (see FIG. 1) of the ink supply devices 322M, 322K, 322C, and 322Y on the basis of control signals sent from the system control unit 330.

The valve control unit 350 controls the opening and closing of valves, such as the supply valve 14, the drain valve 30, the air-connection valve 34, and the air valve 40, on the basis of control signals sent from the system control unit 330.

The recording control unit 360 (an example of recording control unit) controls the conveyance of the sheet 302, which is performed by the drums 310, 312, and 314, and the recording of images, which are recorded by the ink jet heads 320M, 320K, 320C, and 320Y, on the basis of control signals sent from the system control unit 330.

According to the ink jet recording apparatus 300 having the above-mentioned structure, it is possible to record an image on the recording surface of the sheet 302. In this case, the respective inks are appropriately supplied to the ink jet heads 320M, 320K, 320C, and 320Y by the ink supply devices 322M, 322K, 322C, and 322Y. Further, even if operational abnormality occurs in the supply pumps 20 or the recovery pumps 120 of the ink supply devices 322M, 322K, 322C, and 322Y, the elastic diaphragm 22 of the supply sub-tank 18 or the elastic diaphragm 122 of the recovery sub-tank 118 is kept in a shape along the extension surface 223A of the inner wall surface 223 of the liquid chamber 24. Accordingly, since the shape of a protrusion is not formed on the elastic diaphragm, the tearing of the elastic diaphragm does not occur.

The technical scope of the invention is not limited to the scope described in the embodiments. The structures and the like of the respective embodiments can be appropriately combined with each other between the respective embodiments without departing from the scope of the invention.

EXPLANATION OF REFERENCES

12: supply passage
18: supply sub-tank
22, 122: elastic diaphragm
24: liquid chamber
24A, 124A: ink outlet
24B, 124B: ink inlet
26: gas chamber
27, 127: bubble discharge port
52: ink tank
100, 322M, 322K, 322C, 322Y: ink supply device
112: recovery passage
118: recovery sub-tank
210: gas chamber-side tank frame
210: liquid chamber-side tank frame
222: storage portion
223: inner wall surface
223A: extension surface of inner wall surface
223B: flat surface connecting peripheral portions of ink inlet 24A
223B, 232, 236, 246, 250: restriction part
232A: surface of restriction part 232 facing liquid chamber
224, 226, 228: branch pipe portion
242: joint

What is claimed is:

1. A liquid supply device comprising:

an ink passage that allows an ink jet head, which ejects ink from nozzles, to communicate with an ink tank in which ink is stored;

a pump that is provided on the ink passage and applies pressure to ink present in the ink passage;

a back-pressure tank that is provided between the ink jet head and the pump and includes a liquid chamber communicating with the ink passage through a flow port, a gas chamber in which gas is stored, and an elastic diaphragm isolating the liquid chamber from the gas chamber; and a restriction member that is disposed in the flow port on an extension surface of an inner wall surface of the liquid chamber and keeps the elastic diaphragm on an inside of the extension surface in a case in which the elastic diaphragm is sucked into the flow port by the pressure that is applied to the ink by the pump, wherein the restriction member divides the flow port into a plurality of regions.

2. The liquid supply device according to claim 1, wherein the restriction member divides the flow port into a plurality of regions having a size that is determined on the basis of a tensile strength of the elastic diaphragm and the maximum pressure of the pump.

3. The liquid supply device according to claim 2, wherein the flow port includes a first flow port that communicates with the ink jet head through the ink passage and a second flow port that communicates with the pump through the ink passage.

4. The liquid supply device according to claim 3, wherein a first restriction member, which is disposed at the first flow port, divides the first flow port into a plurality of regions having the maximum size, which enables the elastic diaphragm to be kept on the inside of the extension surface, in a case in which the elastic diaphragm is sucked into the first flow port by the pressure that is applied to the ink by the pump.

5. The liquid supply device according to claim 3, wherein a second restriction member, which is disposed at the second flow port, divides the second flow port into a plurality of regions having the minimum size that enables ink to flow in the ink passage by the pressure that is applied to the ink by the pump.

6. The liquid supply device according to claim 4, wherein a second restriction member, which is disposed at the second flow port, divides the second flow port into a plurality of regions having the minimum size that enables ink to flow in the ink passage by the pressure that is applied to the ink by the pump.

7. The liquid supply device according to claim 1, wherein the restriction member divides the flow port into a plurality of circular regions.

8. The liquid supply device according to claim 2, wherein the restriction member divides the flow port into a plurality of circular regions.

9. The liquid supply device according to claim 3, wherein the restriction member divides the flow port into a plurality of circular regions.

10. The liquid supply device according to claim 4, wherein the restriction member divides the flow port into a plurality of circular regions.

11. The liquid supply device according to claim 5, wherein the restriction member divides the flow port into a plurality of circular regions.

12. The liquid supply device according to claim 6, wherein the restriction member divides the flow port into a plurality of circular regions.

13. The liquid supply device according to claim 1, wherein the liquid chamber includes a discharge port that communicates with the ink tank through a discharge passage.

14. The liquid supply device according to claim 1, wherein the liquid chamber includes a discharge port that communicates with the ink tank through a discharge passage.

15. The liquid supply device according to claim 2, wherein the liquid chamber includes a discharge port that communicates with the ink tank through a discharge passage.

16. The liquid supply device according to claim 3, wherein the liquid chamber includes a discharge port that communicates with the ink tank through a discharge passage.

17. The liquid supply device according to claim 1, wherein the restriction member is formed integrally with the liquid chamber.

18. An image recording apparatus comprising:

an ink tank in which ink is stored;

an ink jet head that ejects ink from nozzles;

a supply unit that uses the liquid supply device according to claim 1, is disposed between the ink tank and the ink jet head, and supplies the ink, which is stored in the ink tank, to the ink jet head;

a moving unit that moves a recording medium relative to the ink jet head; and a recording control unit that records an image on a recording surface of the recording medium by ejecting ink from the nozzles of the ink jet head while relatively moving the recording medium.

19. An image recording apparatus comprising:

an ink tank in which ink is stored;

an ink jet head that ejects ink from nozzles;

a supply unit that uses the liquid supply device according to claim 1 disposed between the ink tank and the ink jet head, and supplies the ink, which is stored in the ink tank, to the ink jet head;

a recovery unit disposed between the ink jet head and the ink tank, and recovers the ink, which is supplied to the ink jet head, to the ink tank;

a moving unit that moves a recording medium relative to the ink jet head; and a recording control unit that records an image on a recording surface of the recording medium by ejecting ink from the nozzles of the ink jet head while relatively moving the recording medium.

* * * * *